US008915197B2

(12) United States Patent
Raml

(10) Patent No.: US 8,915,197 B2
(45) **Date of Patent: *Dec. 23, 2014**

(54) DECK LEDGE TABLE

(71) Applicant: Joseph P. Raml, Sheboygan, WI (US)

(72) Inventor: Joseph P. Raml, Sheboygan, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/059,103

(22) Filed: Oct. 21, 2013

(65) Prior Publication Data

US 2014/0130719 A1 May 15, 2014

Related U.S. Application Data

(63) Continuation-in-part of application No. 13/589,572, filed on Aug. 20, 2012, now Pat. No. 8,561,550.

(60) Provisional application No. 61/524,837, filed on Aug. 18, 2011.

(51) Int. Cl.

| | |
|---|---|
| ***A47B 37/00*** | (2006.01) |
| ***A47B 5/00*** | (2006.01) |
| ***A47B 5/02*** | (2006.01) |
| ***A47B 37/04*** | (2006.01) |

(52) U.S. Cl.

CPC ... *A47B 5/02* (2013.01); *A47B 5/00* (2013.01); *A47B 37/04* (2013.01)

USPC ..... 108/42; 108/152

(58) Field of Classification Search

CPC ..... A47B 96/027

USPC ..... 108/42, 152, 40, 48, 90; 211/90.01, 211/87.01, 86.01, 88.01, 90.02; 248/245, 248/235, 240, 241, 205.1, 238; 24/525, 569

See application file for complete search history.

(56) References Cited

U.S. PATENT DOCUMENTS

| | | | | |
|---|---|---|---|---|
| 4,708,309 | A | 11/1987 | Walter | |
| 4,889,057 | A | 12/1989 | Chartrand | |
| 5,240,214 | A | 8/1993 | Birnbaum et al. | |
| 5,528,993 | A | 6/1996 | Vincelli | |
| 5,535,973 | A | 7/1996 | Bailey et al. | |
| D376,708 | S | 12/1996 | Robertson et al. | |
| 5,653,178 | A | 8/1997 | Huczka | |
| 5,685,517 | A | 11/1997 | Salibra | |
| 5,722,329 | A * | 3/1998 | Weng | 108/47 |
| 5,895,017 | A | 4/1999 | McMillan, Jr. | |
| 6,059,300 | A | 5/2000 | Wu | |
| 6,079,336 | A | 6/2000 | Lindstrom | |
| 6,082,270 | A | 7/2000 | Zerger | |
| 6,098,552 | A | 8/2000 | Gunderson | |
| 6,105,509 | A * | 8/2000 | Altfeder | 108/42 |
| 6,370,741 | B1 | 4/2002 | Lu | |
| 6,439,134 | B1 | 8/2002 | Ryburg | |
| 6,513,566 | B2 | 2/2003 | Larin | |

(Continued)

*Primary Examiner* — Jose V Chen

(74) *Attorney, Agent, or Firm* — Boyle Fredrickson, S.C.

(57) ABSTRACT

A deck table is provided that includes a table section and a clamping mechanism that are attachable to a number of vertical posts in order to position the support surface on the posts in a horizontal position. The table section includes support surface and a bottom support that can be positioned against the posts and engaged by the clamping mechanism that extends between the posts. The clamping mechanism is rotatably attached to the table section and can be releasably engaged with the vertical posts to enable the table to be readily repositioned and/or removed from the posts, as desired, without disassembly of the component parts of the table.

12 Claims, 7 Drawing Sheets

(56) References Cited

U.S. PATENT DOCUMENTS

| | | | | |
|---|---|---|---|---|
| 6,546,879 | B1 | 4/2003 | Johnston | |
| 6,705,235 | B1 * | 3/2004 | Gerutto | 108/47 |
| 6,736,073 | B2 | 5/2004 | Ryburg | |
| 6,931,998 | B1 | 8/2005 | Leese | |
| 6,984,066 | B2 | 1/2006 | Borom | |
| 7,121,213 | B2 | 10/2006 | Viazanko et al. | |
| 7,210,414 | B1 | 5/2007 | Barone | |
| 7,421,958 | B2 | 9/2008 | Ciulla | |
| 7,533,618 | B2 | 5/2009 | Thomason | |
| 7,686,267 | B2 * | 3/2010 | DaSilva | 248/229.12 |
| 7,966,948 | B1 | 6/2011 | Galietti | |
| 8,561,550 | B2 * | 10/2013 | Raml | 108/42 |
| 2005/0204521 | A1 | 9/2005 | Hughto-Delzer et al. | |
| 2012/0047711 | A1 | 3/2012 | Meyer | |
| 2012/0074282 | A1 | 3/2012 | Willey | |

* cited by examiner

DECK LEDGE TABLE

CROSS-REFERENCE TO RELATED APPLICATIONS

This application claims priority as a continuation-in-part of U.S. Non-Provisional Application Ser. No. 13/589,572, filed on Aug. 20, 2012, now U.S. Pat. No. 8,561,550, which claims priority from U.S. Provisional Application Ser. No. 61/524,837, filed on Aug. 18, 2011, the entirety of which are each hereby expressly incorporated by reference herein.

FIELD OF THE DISCLOSURE

The present invention relates generally to a support surface in the form of a table, and more particularly to a table adapted for use on a deck.

BACKGROUND OF THE DISCLOSURE

There are many types of tables and other support surfaces that are used to hold objects at desired positions and locations. The vast majority of these tables are free-standing, in that the tables are supported by legs or other support members extending downwardly from the table top into contact with a floor or other surface to hold the table top at the desired location.

However, in certain environments there is a limited amount of space on a surface upon which to support a table. In these environments, tables have been developed that minimize the area of the surface necessary for supporting the table. In the designs for these tables, the table includes legs or similar support members disposed on one side of the table that engage the surface over which the table is positioned. Opposite the legs, the table includes a mechanism that enables the table to be engaged with a non-horizontal support surface in order to position the table where desired.

However, one main drawback for these types of tables adapted for use with a non-horizontal support surface is that the engagement mechanism holding the table on the non-horizontal support surface must be disassembled and/or removed from the table in order relocate the table from one location to another.

Also, in many situations there is a limited amount of surface area available on which tables, chairs and other items can be positioned. Therefore, in these situations where surface area is limited, it is desirable to develop a table that can be positioned at the desired location by attaching the table to another structure near the floor or other surface, while not obscuring any part of the surface over which the table is positioned with legs or similar vertical support members.

Furthermore, it is desirable to develop a table which can be moved from one location to another without requiring the disassembly of the table's members.

SUMMARY OF THE DISCLOSURE

Briefly described, one aspect of the present disclosure provides a table that includes a clamping mechanism that enables the table to be releasably secured to vertical structural members, such as the slats of a deck ledge or rail. The table includes a table section support surface or table top including a bottom support affixed to the bottom surface of the table top. The table section is engaged with a clamping assembly. The clamping assembly operates to engage the table with the vertical structural members, and includes a screw that can be moved into and out of the table section by rotating the screw with regard to the table section. When moved into the table section, a back clamp secured to the screw opposite the table section is moved towards the table section, such that any structure positioned between the table section and the back clamp is frictionally engaged therebetween.

According to another aspect of the present disclosure, a biasing member is positioned around the screw between the back clamp and the table section. The biasing member provides a force against the movement of the back clamp towards the table section that aids in disengagement of the back clamp and table section from the vertical structure(s), easing the removal of the table.

According to still another aspect of the present invention, the back clamp is rotatably attached to the screw, such that the back clamp can rotate with respect to the screw and table section. In this construction, the back clamp can be rotated to be aligned with the spaces between the vertical members to which the back clamp can be secured. Thus, the back clamp can remain attached to the table section via the screw when being secured or unsecured from the vertical members allowing for attachment of the table by a single individual.

According to still another aspect of the present invention, the table top can be releasably secured to the bottom support. In this manner, the bottom support can be maintained engaged on the vertical members, while the shape or form of the table top positioned on the bottom support can be varied as desired.

Numerous other aspects, features, and advantages of the present invention will be made apparent from the following detailed description together with the drawings figures.

BRIEF DESCRIPTION OF THE DRAWINGS

The drawings illustrate the best mode currently contemplated of practicing the present disclosure.

In the drawings.

DETAILED DESCRIPTION OF THE DISCLOSURE

Figure 1:
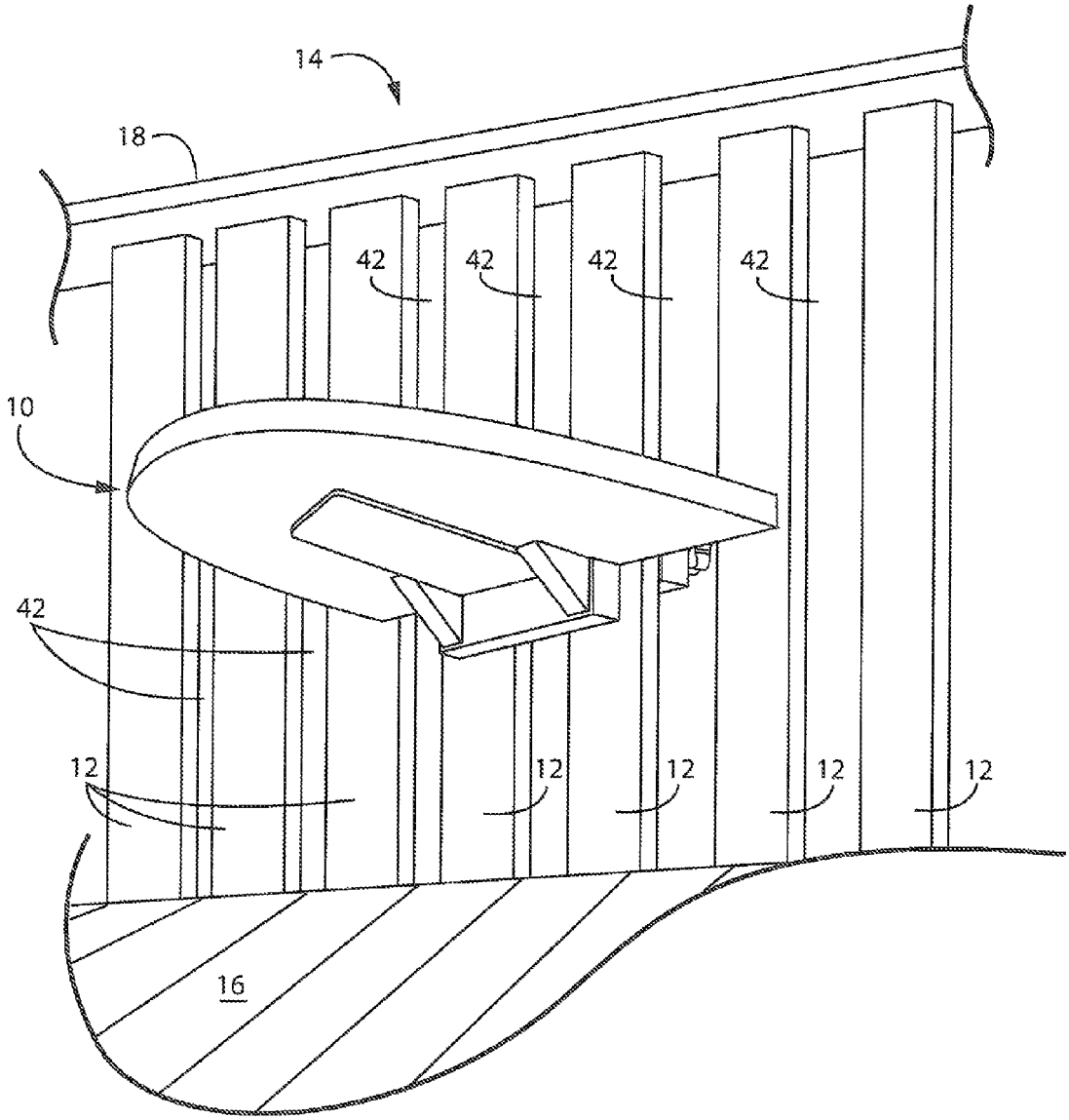
FIG. 1 is a perspective view of a first embodiment of a table constructed according to the present disclosure.
Figure 2:
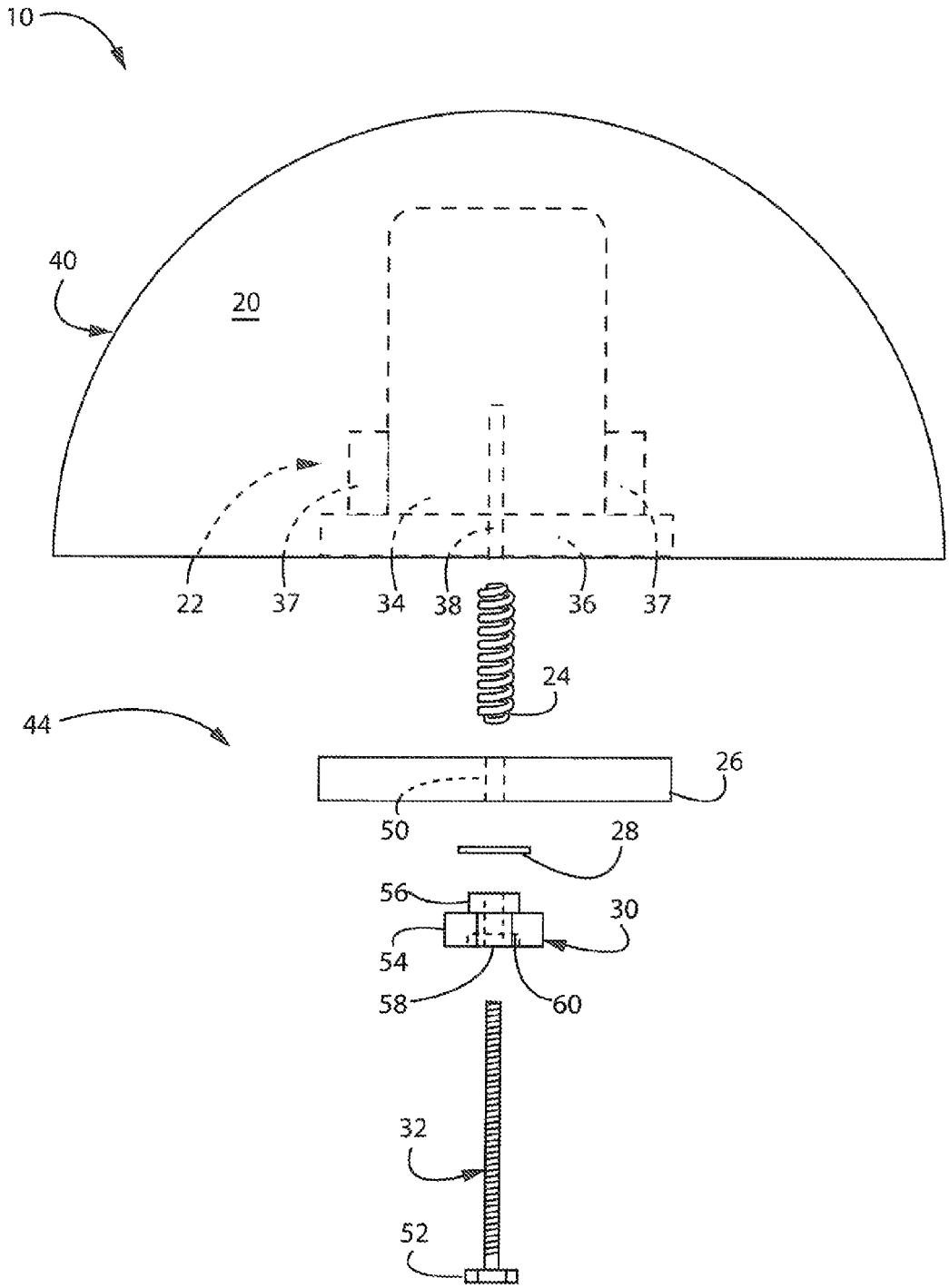
FIG. 2 is an exploded top plan view of the table of FIG. 1.
Figure 3:
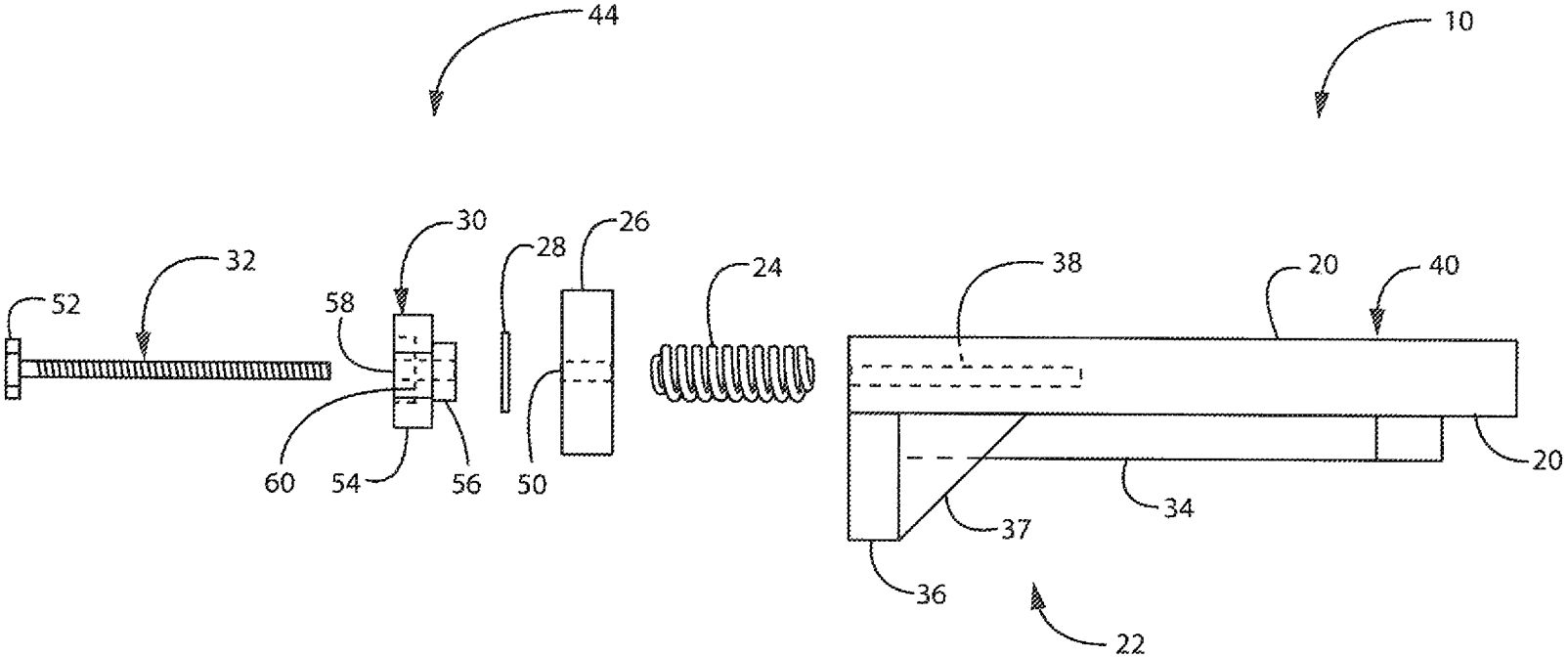
FIG. 3 is an exploded side plan view of the table of FIG. 1.
Figure 4:
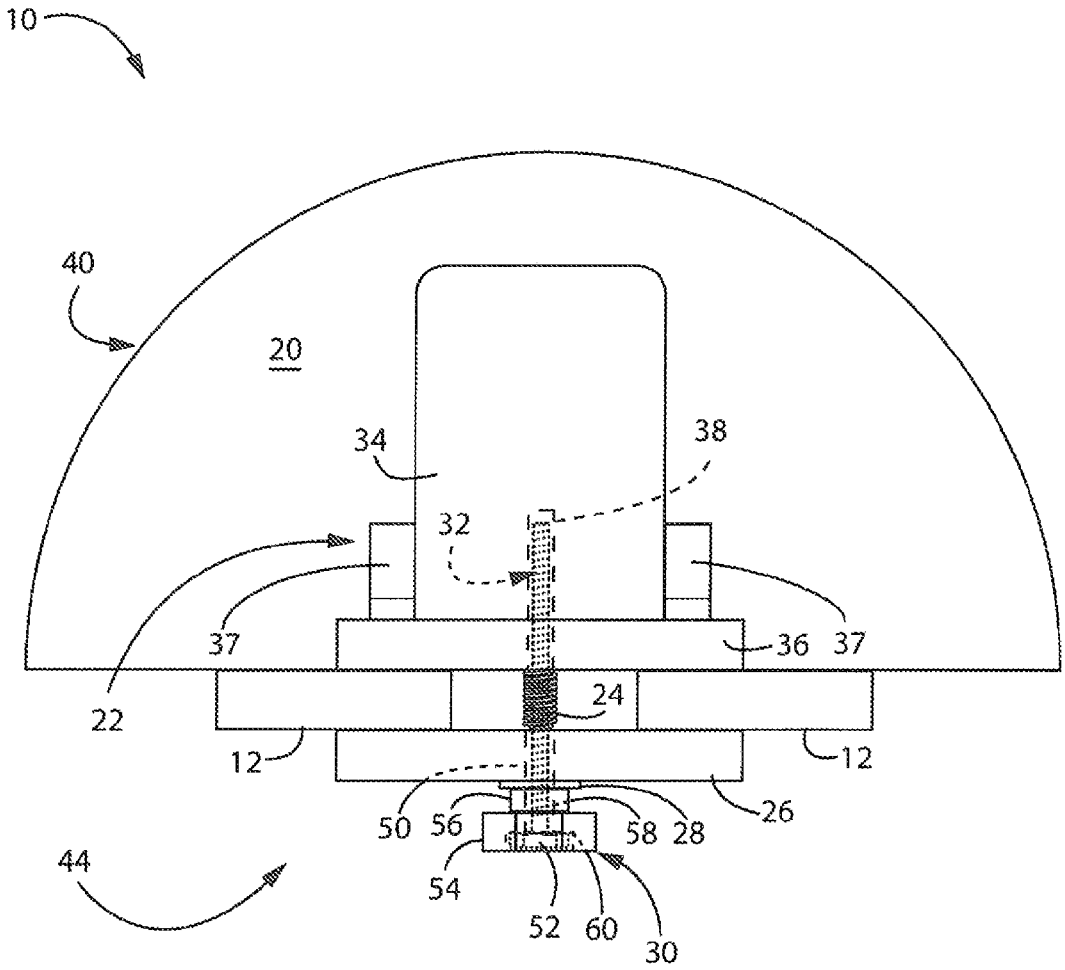
FIG. 4 is a bottom plan view of the table of FIG. 1 in an engaged position.
Figure 5:
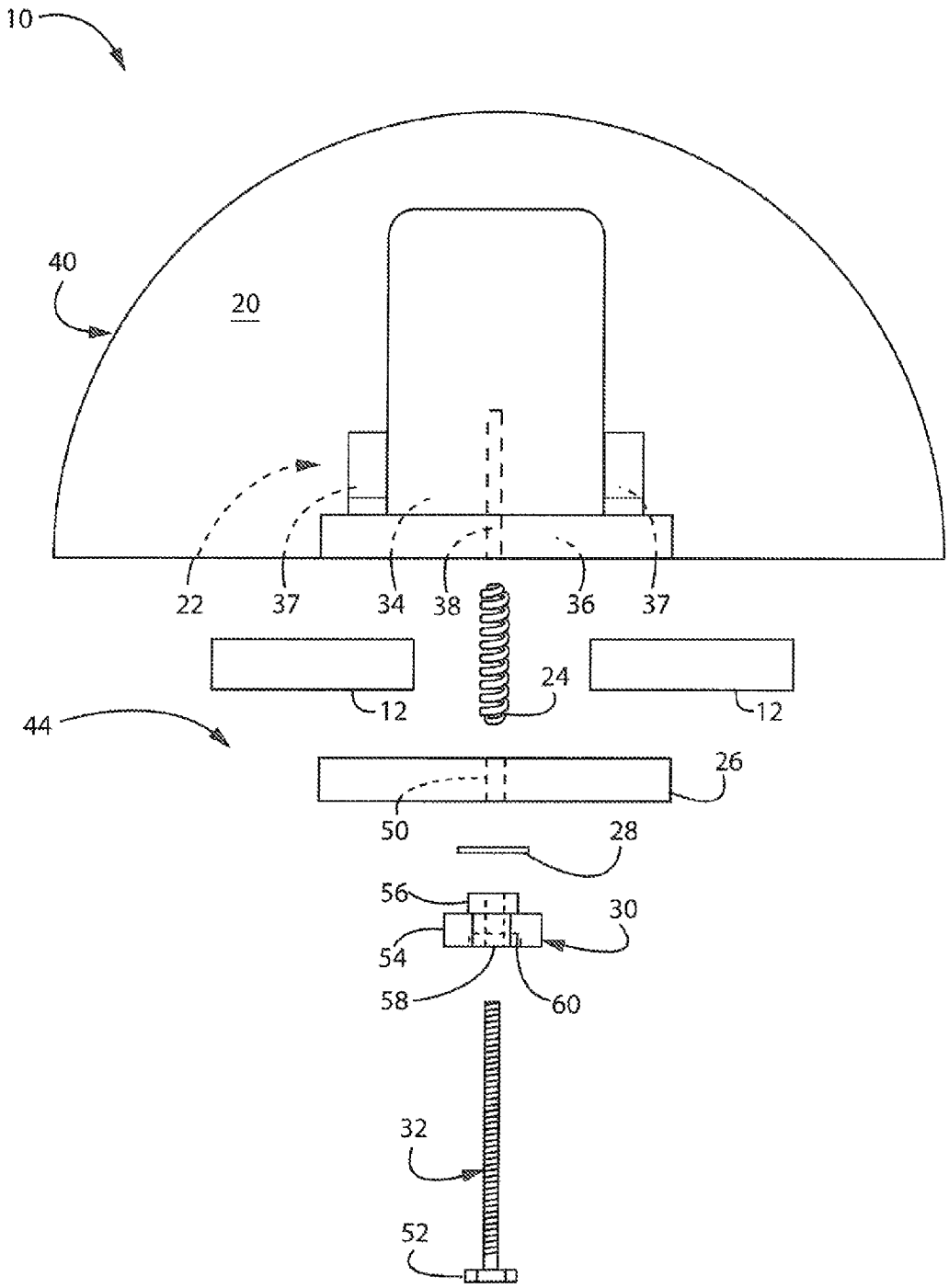
FIG. 5 is a bottom plan view of the table of FIG. 1 in a disengaged position.

Referring now in detail to the drawing figures, wherein like reference numerals represent like parts throughout the several views, one embodiment of a table constructed according to the present disclosure is illustrated generally at 10 in FIG. 1. The table 10 is secured to at least one, and preferably two or more vertical posts 12, such as those forming a part of a ledge or railing 14 positioned around the periphery of a deck 16. The posts 12 are connected to one another at the bottom end by the deck 16 and at the top end by a hand rail 18.

Referring now to FIGS. 2-5, the table 10 includes a table section 40, comprised of a support surface 20 and a bottom support 22. The table portion 40 can be formed of any suitable material, such as a plastic, wood or metal. The bottom support 22 includes a flat portion 34 secured to the support surface 20 and a projecting portion 36 attached to the flat portion 34 and extending downwardly from the support surface 20. The bottom support 22 can also include braces 37 connected between the projecting portion 36 and the support surface 20 to provide additional strength and rigidity to the table section 40.

The projecting portion 36 and flat portion 34 define a channel 38 therein for receiving and engaging a fastener 32 forming a part of a clamping assembly 44. In an alternative embodiment, the channel 38 can also be formed in the support surface 20. The channel 38 includes a configuration that enables the fastener 32 to be engaged and held within the channel 38. In one embodiment the channel 38 is internally threaded (not shown) in order to engage exterior threads on the fastener 32, which holds the fastener 32 in engagement with the table portion 40. The internal surface of the channel 38 may also include a separate structure, such as a cylindrical threaded insert (not shown), that provides the surface for engagement with the fastener 32.

Also, referring to FIGS. 2-5, the clamping assembly 44 in the illustrated embodiment is comprised of a spring or biasing member 24, a back clamp 26, a washer 28, a knob 30, as well as the fastener 32. The back clamp 26 can be formed from any suitable material, such as a plastic, wood or metal, which can also be selected a material similar to the material used for the table section 40. The back clamp 26 can optionally be formed with a suitable cushioning material (not shown) on one surface of the clamp 26. The material can be positioned against the vertical posts 12 in order to minimize any damage to the clamp 26 or the posts 12. Additionally, the cushioning material can also optionally be positioned on the table portion 40 in order to protect the table portion 40 and the posts 12 opposite the clamp 26.

The back clamp 26 is mounted to the fastener 32 through an aperture 50 extending through the hack clamp 26, such that the back clamp 26 can rotate freely with regard to the fastener 32. The fastener 32 includes a head 52 disposed opposite the table portion 40 that has a diameter larger than the aperture 52 in order to prevent the back clamp 26 from coming off of the fastener 32.

To assist in holding the back clamp 26 on the fastener 32, and to assist in the rotation of the fastener 32 with regard to the table section 40, the knob 30 is disposed on the head 52 of the fastener 32. The knob 30 can be formed with any suitable shape and of any suitable material, and includes a grasping portion 54 and a collar 56 disposed concentrically on and extending outwardly from the grasping portion 54. Both the grasping portion 54 and the collar 56 define a central passage 58 through which the fastener 32 can extend. The grasping portion 54 also includes a recess 60 opposite the collar 56 that is shaped complementary to the head 52 of the fastener 32. Thus, when the fastener 32 is fully inserted through the passage 58, the head 52 nests within and is engaged by the recess 60. In this manner, when the grasping portion 54 is grasped to turn the knob 30, the turning of the knob 30 also turns the fastener 32 as a result of the engagement between the head 52 and the recess 60.

The rotation of the knob 30 with respect to the back clamp 26 is facilitated by the presence of the washer 28 around the fastener 32 between the collar 56 of the knob 30 and the back clamp 26. The washer 28 reduces the friction between the knob 30 and the clamp 26, enabling the clamp 26 and knob 30 to rotate relatively freely with respect to one another to engage or disengage the clamp 26 from the vertical posts 12.

To assist in the disengagement of the clamp 26 from the posts 12 when desired, the clamping assembly 44 also includes the biasing member 24. The biasing member 24 in the illustrated embodiment is formed as a helical coil spring defining an opening through which the fastener 32 extends, though other suitable biasing members can also be utilized, such as Bellville springs or a compressible foam material, among others which can also be attached to one or both of the back clamp 26 and the table section 40 separate from the fastener 32. The biasing force of the biasing member 24 presses the clamp 26 away from the table section 40, thereby aiding an individual, in releasing the clamp 26. In the illustrated embodiment, the diameter of the biasing member 24 is selected such that the diameter of the biasing member 24 is greater than the diameter of the channel 38, thereby preventing the biasing member 24 from entering the channel 38. However, depending upon the particular structure or configuration for the biasing member 24, the biasing member 24 can be disposed partially within the channel 38.

In use, to secure the table 10 to the vertical posts 12, initially the knob 30 and fastener 32 are rotated to move the back clamp 26 away from the table section 40 to a position where the clamp 26 can move with respect to the knob 30 and fastener 32. The clamp 26 is rotated into a vertical orientation where the clamp 26 can be moved through the gap 42 formed between adjacent vertical posts 12. The clamp 26 is subsequently moved between adjacent posts 12 through the gap 42. The table section 40 and clamp 26 are then positioned at the desired height within the gap 42. The back clamp 26 is then rotated ninety (90) degrees to a horizontal orientation in order to position the clamp 26 over one or more of the vertical posts 12.

When the table section 40 and clamp 26 are positioned where desired, the knob 30 is grasped and turned in order to move the fastener 32 into the channel 38. This consequently draws the clamp 26 towards the table section 40 against the bias of the biasing member 24, such that the clamp 26 and table section 40 frictionally engage the vertical posts 12. The knob 30 is continued to be turned until the clamp 26 and table section 40 are sufficiently engaged with the vertical posts 12 to hold the table 10 where desired.

Further, as the fastener 32 is engaged within the channel 38 in the table section 40, the fastener 32 compresses the biasing member 24. The bias of the spring 24 acts against the back clamp 26, such that when it is desired to remove the table 10, the bias of the spring 24 assists in urging the back clamp 26 away from the vertical posts 12. However, the bias of the spring 24 is not sufficient to move the fastener 32 out of the channel 38 without the corresponding movement of the fastener 32, which can be actuated by pressing and turning knob 30, to maintain the table 10 in engagement with the railing 14 or to release the table 10 from engagement with the railing 14.

The table 10 is secured to the rail 16 by the frictional engagement of the back clamp 26 and the back areas of table section 40 with opposite sides of the vertical posts 12. To reposition the table 10 within the gap 42, the fastener 32, which can be moved in relation to the table section 40 by pressing and turning the knob 30, is simply moved away from the table section 40, consequently moving the back clamp 26 away from the posts 12. The table 10 can then be slid vertically along the posts 12 and within the gap 42 and the fastener 32 moved back toward the table section 40, until frictional engagement with table 10 and the vertical posts 12 is accomplished. Furthermore, the table 10 can be removed by moving fastener 32 away from table section 40, rotating the back clamp 26 to a vertical position and removing the entire, intact, table 10 from the vertical posts 12. The table 10 can then be relocated to a desired location between any suitable vertical posts 12.

In a second embodiment of the table 100 shown in FIGS. 6-9, the table top or support surface 200 is separable from the bottom support 220, with the fastener 320 extending through the aperture 508 in the back clamp 260 into the channel 380, which is formed in the bottom support 220. While the fastener 320 can include the biasing member 24, washer 28, and knob 30 from the embodiment of FIGS. 1-5, it is also contemplated that the back clamp 260 can be held in engagement with the bottom support 220 only by the fastener 320, such that the fastener 320 can be moved into and out of engagement within the channel 380 in the bottom support 220 using only the head 520 on the fastener 320.

Figure 7:
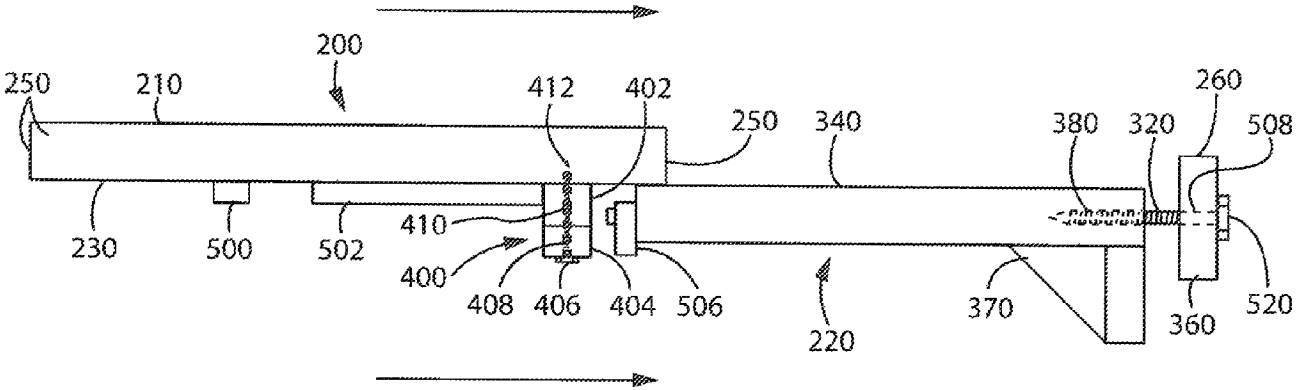
FIG. 7 is a side plan view of the table of FIG. 6.
Figure 6:
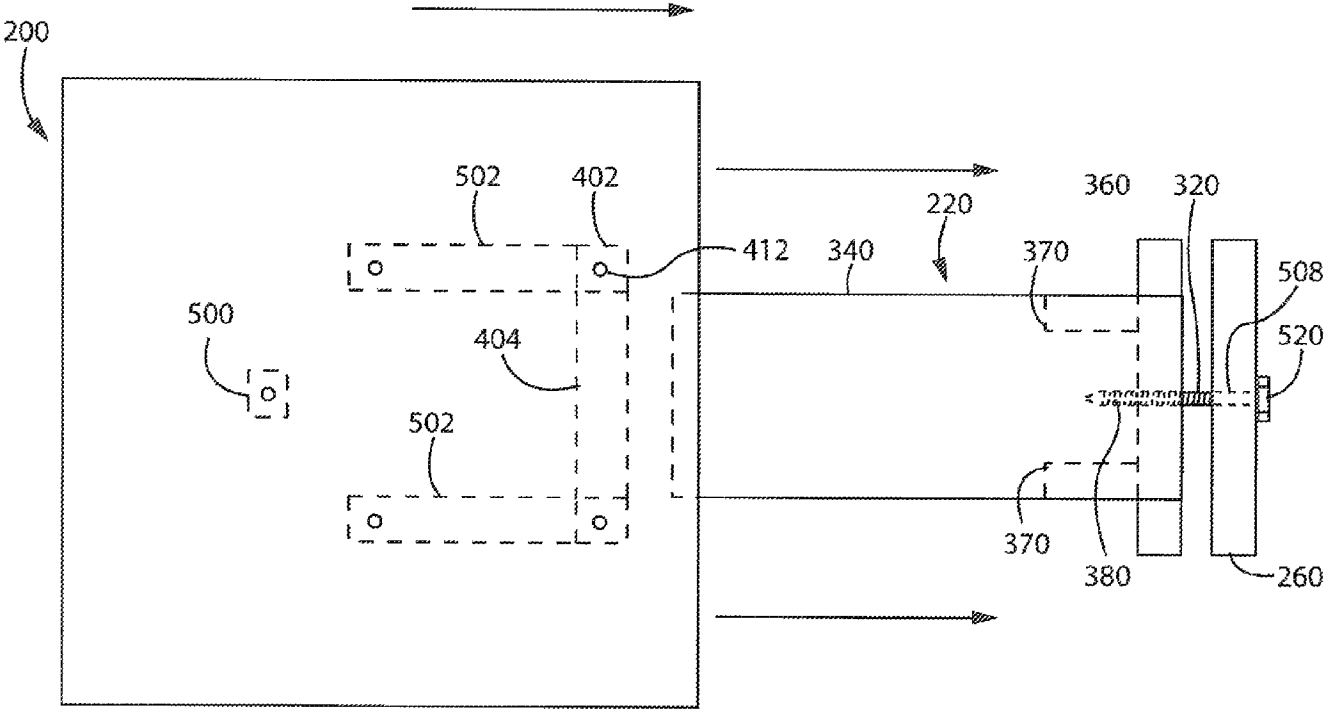
FIG. 6 is a top plan view of a second embodiment of a table constructed according to the present disclosure in a disassembled position.

Looking now at FIGS. 6 and 7, bottom support 220 is formed similarly to the bottom support 22 in the first embodiment, with a flat portion 340 positioned adjacent and against the support surface 200 and a projecting portion 360 attached to the flat portion 340 and extending downwardly from the flat portion 340. The bottom support 220 can also include braces 370 connected between the flat portion 340 and the projecting portion 360 to provide additional strength and rigidity to the bottom support 220.

The table top 200 is formed with a top surface 210 and a bottom surface 230 joined by a number of side surfaces 250, and, while shown as being square in the illustrated embodiment, can have any desired shape (e.g., polygonal, round, oblong, etc.) defined by any desired number and configuration of side surfaces 250. The table top 200 includes a bracket 400 secured to the bottom surface 230 of the table top 200. The bracket 400 extends downwardly from the bottom surface 230 and can be affixed to the table top 200 in any suitable manner. The bracket 400 can also be formed of any desired material, which can be different than or similar to the material utilized to form the table top 200.

Figure 8:
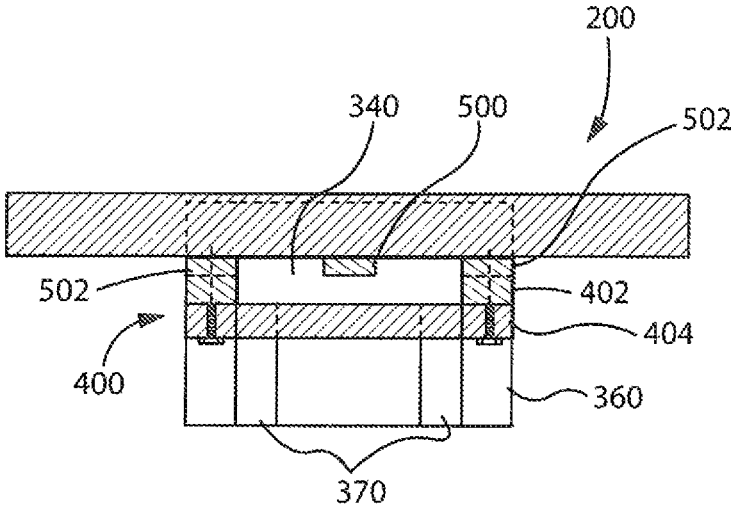
FIG. 8 is a front plan view of the table of FIG. 6 is an assembled position.

In the embodiment best illustrated in FIGS. 6 and 8, the bracket 400 includes a pair of spacers 402 connected to the bottom surface 230 of the table top 200 and spaced from one another. The spacers 402 are joined by a beam 404 that is connected to each of the spacers 402 opposite the table top 200 to define a slot 405 between the bottom surface 230 of the table top 200, the spacers 402 and the beam 404. The spacers 402 and the beam 404 can be joined to one another to form the bracket 400 in any suitable manner, such as by a mechanical fastener or adhesive, and in the illustrated embodiment are connected by screws 406 that are inserted through aligned apertures 408 and 410 in the beam 404 and spacers 402, respectively, and into corresponding bores 412 in the table top 200 to effectively secure the bracket 400 to the table top 200. Additionally, when screws 406 are used, they can be adjusted to vary the size of the slot 405 defined by the bracket 400 as necessary.

Figure 9:
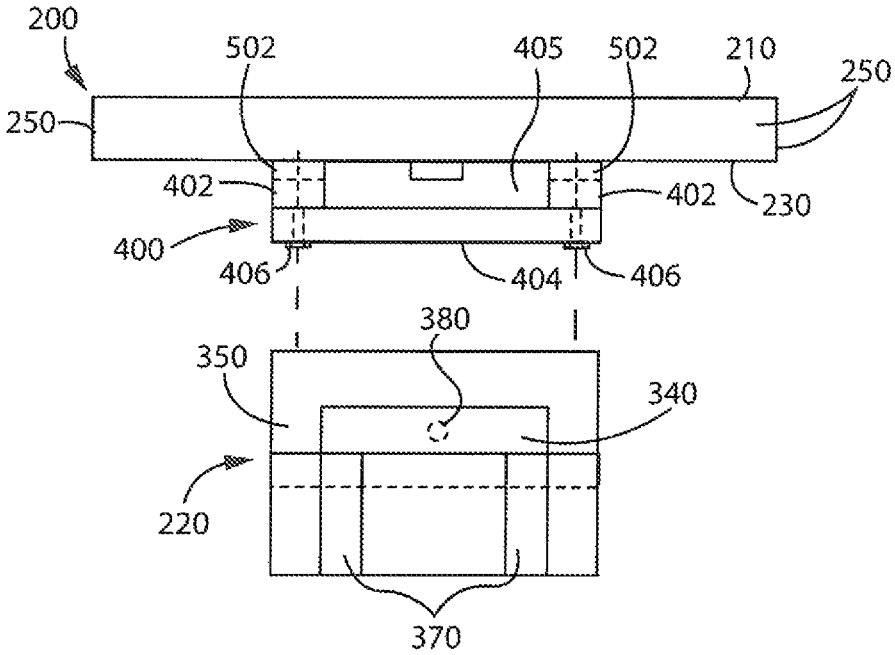
FIG. 9 is a front plan view of the table of FIG. 6 is a fully disengaged position.

Looking now at FIGS. 7-9, the shape and orientation of the spacers 402 and beam 404 to define the slot 405 within the bracket 400 is selected to correspond to the peripheral shape of the bottom support 220, which can have any suitable configuration, but in the illustrated embodiment is shown as being generally rectangular in shape. The area of the slot 405 is formed to be slightly larger than the cross-sectional shape or area of the bottom support 220, such that the bottom support 220 can slide into the slot 405. The positioning of the bracket 400 on the table top 200 is such that the bracket 400 is able to be positioned relatively close to the back clamp 260, such that the bottom support 220 provides a sufficient amount of support to the table top 200 positioned on the bottom support 220. Further, when it is desired to change the table top 200 for any desired reason, the table top 200 can simply be slid off of the flat portion 340 and replaced with another table top 200 having a bracket 400 thereon capable of slidably engaging the flat portion 340 of the bottom support 220.

In other embodiments, the table top 200 can include a stop 500 secured to or disposed on the bottom surface 230 and spaced from the bracket 400 to engage the fiat portion 340 of the bottom support 220 when inserted through the slot 405 in the bracket 400 to limit the extent the bottom support 220 can extend through the bracket 400. In conjunction with the stop 500, or used independently therefrom, the table top 200 can also include one or more guide members 502 disposed on the sides of the bracket 400 and extending towards the stop 500. The guide members 502 are spaced slightly wider than the width of the flat portion 340 of the bottom support 220 to enable the guide members 502 to guide the bottom support 220 as it moves through and out of the bracket 400. Additionally, in other embodiments the table top 200 can include multiple brackets 400 to engage multiple bottom supports 220 in order to provide additional stability to the table top 200. The table top 200 may also include a lock (not shown) capable of engaging the bottom support 220 when positioned thereon in order to secure the table top 200 to the bottom support 220 and prevent inadvertent disengagement of the bracket 400 and table top 200 from the bottom support 220.

The stop 500 can also be omitted in an alternative embodiment where the length of the braces 370 positioned against the flat portion 340 is selected to provide the function of the stop 500 by the engagement of the braces 370 with the beam 404 of the bracket 400 to properly position the table top 200 on the bottom support 220. In addition, the bottom support 220 can also include a lock 506 disposed opposite the projecting portion 360. The lock 506 is rotatably secured to the flat portion 340 and can rotate between a horizontal position where the lock 506 rest within the cross-sectional area of the flat portion 340, enabling the flat portion 340 to be inserted through the slot 405, and a vertical position (FIG. 7) where the lock 506 extends outwardly past the flat portion 340, such that the lock 506 can engage the beam 404 of the bracket 400 and prevent the table top 200 from being removed from the bottom portion 220. The lock 506 could also be rotated into a corresponding notch (not shown) or other recess in the bottom surface 230 of the table top 200 to directly engage and lock the table top 200 to the bottom support 220.

Various other embodiments of the present invention are contemplated as being within the scope of the filed claims particularly pointing out and distinctly claiming the subject matter regarded as the invention.

The invention claimed is:

1. A table adapted to be secured to one or more vertical members, the table comprising:

a) a support surface;

b) a bottom support releasably engaged with the support surface; and c) a clamp mechanism rotatably engaged with the bottom support to clamp one or more vertical members therebetween in order to position the support surface on the vertical members, wherein the clamp mechanism remains completely intact and rotatably engaged with the bottom support when removing the support surface from the one or more vertical members, wherein the clamp mechanism includes:

i) a back clamp; and ii) a fastener connected to the back clamp and rotatably engaged with the bottom support to selectively engage an engagement surface on the back clamp with the one or more vertical members to hold the table in a desired position with respect to the vertical members, wherein the fastener defines a first axis and wherein the back clamp is rotatable around the first axis between a horizontal position where the back clamp is positioned to engage the vertical members and a vertical position where the back clamp is positioned to pass between the vertical members.

2. The table of claim 1 wherein the clamp mechanism includes a biasing member disposed between the support surface and the back clamp.

3. The table of claim 2 wherein the fastener extends through an opening in the biasing member.

4. The table of claim 1 further comprising at least one bracket secured to the support surface, the bracket slidably engageable with the bottom support.

5. The table of claim 4 wherein the bracket defines a slot through which the bottom support can be slidably positioned.

6. The table of claim 5 wherein the slot conforms to the cross-sectional shape of the bottom support.

7. The table of claim 4 further comprising at least one guide surface positioned on the support surface adjacent the at least one bracket.

8. The table of claim 4 further comprising at least one stop disposed on one of the bottom support or the table top.

9. A method of positioning a table on a number of vertical members in a horizontal position, the method comprising the steps of:

a) providing a the table of claim 1;

b) positioning the bottom support against the vertical members;

c) engaging the clamp mechanism to engage the vertical members between the clamp mechanism and the bottom support; and d) engaging the support surface with the bottom support.

10. The method of claim 9 wherein the clamp mechanism includes a back clamp and a fastener connected to the back clamp and rotatably engaged with the bottom support, and wherein the step of engaging the clamp mechanism comprises rotating the fastener with respect to the bottom support to draw the back clamp towards the bottom support.

11. The method of claim 9 wherein the step of engaging the support surface with the bottom support comprises slidably engaging a bracket on the support surface around the bottom support.

12. A table adapted to be secured to one or more vertical members, the table comprising:

a) a support surface;

b) a bottom support releasably engaged with the support surface; and c) a clamp mechanism engaged with the bottom support to clamp the support surface to the bottom support, wherein the clamp mechanism remains completely intact and engaged with the bottom support when removing the support surface, wherein the clamp mechanism includes:

i) a clamp; and ii) at least one fastener connected to the clamp and rotatably engaged with the bottom support to selectively engage an engagement surface on the clamp with the support surface to hold the support surface in a desired position with respect to the bottom support.

* * * * *